US005207615A

United States Patent [19]

Edmisten

[11] Patent Number: 5,207,615

[45] Date of Patent: May 4, 1993

[54] DAMPER ASSEMBLY FOR AIR PLENUM SYSTEM

[76] Inventor: John H. Edmisten, P.O. Box 2028, Boone, N.C. 28607

[21] Appl. No.: 783,132

[22] Filed: Oct. 28, 1991

[51] Int. Cl.[5] ..... F24F 13/06

[52] U.S. Cl. ..... 454/322; 251/297; 251/305; 454/284

[58] Field of Search ..... 454/284, 292, 322, 333; 126/292; 251/297, 305, 308

[56] References Cited

U.S. PATENT DOCUMENTS

| | | | |
|---|---|---|---|
| 518,785 | 4/1894 | Lenderking | 126/292 |
| 971,285 | 9/1910 | Leo | 126/295 |
| 1,202,700 | 10/1916 | Frost . | |
| 1,358,854 | 11/1920 | Kendall . | |
| 1,422,868 | 7/1922 | Kasch et al. . | |
| 2,134,844 | 11/1938 | Schartow | 126/292 |
| 2,342,877 | 2/1944 | Maage, Jr. . | |
| 2,414,503 | 1/1947 | Anderson . | |
| 2,702,504 | 2/1955 | Guildford | 454/333 |
| 4,236,668 | 12/1980 | Prikkel, III . | |
| 4,691,689 | 9/1987 | Shepherd et al. . | |

*Primary Examiner*—Robert G. Nilson
*Attorney, Agent, or Firm*—Bell, Seltzer, Park & Gibson

[57] ABSTRACT

An air plenum system is disclosed which is adapted to distribute air from a central air plenum through a plurality of air duct lines, with a predetermined and readily adjustable air flow rate through each of the lines. A damper plate is pivotally mounted in each of the lines at a location sufficiently close to the outlet end of the line so as to permit a person to reach into the line through the outlet end, and manually pivot the damper plate to a desired setting. Also, the damper plate is mounted by a pair of rods which mount spring loaded washers which bear against the wall of the air duct line and provide a simple, reliable, and readily adjustable system for controlling the pivotal movement of the damper plate. An adjustable air diffuser is preferably mounted to cover the outlet end of each line.

9 Claims, 3 Drawing Sheets

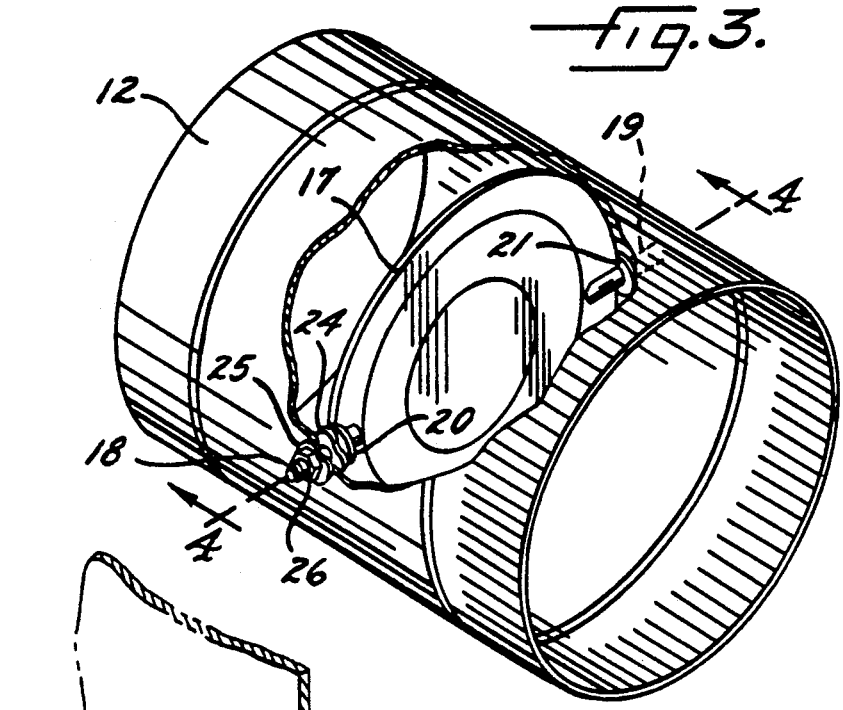
Fig. 3.
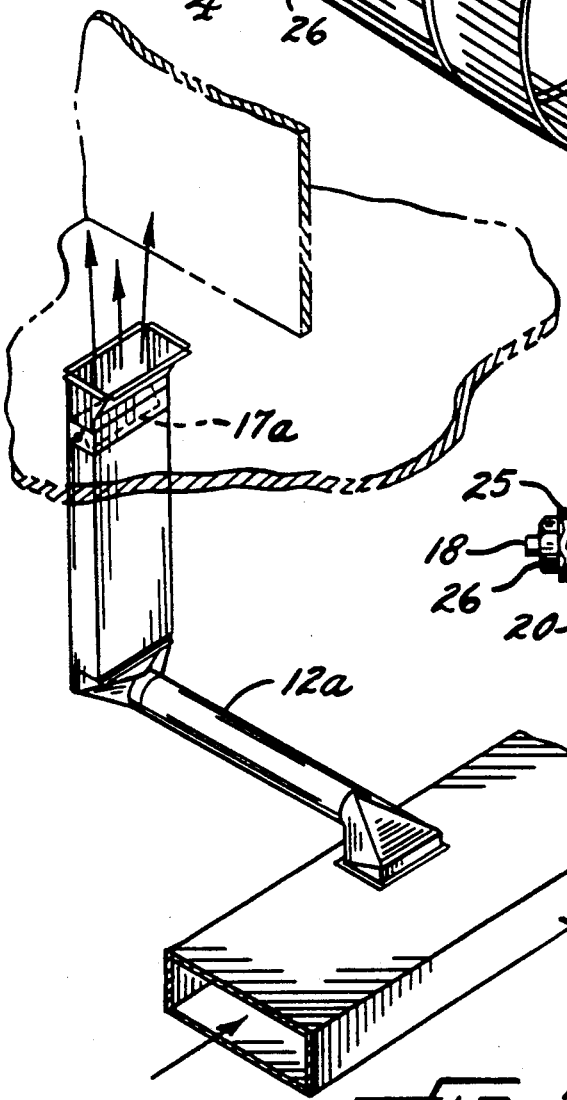
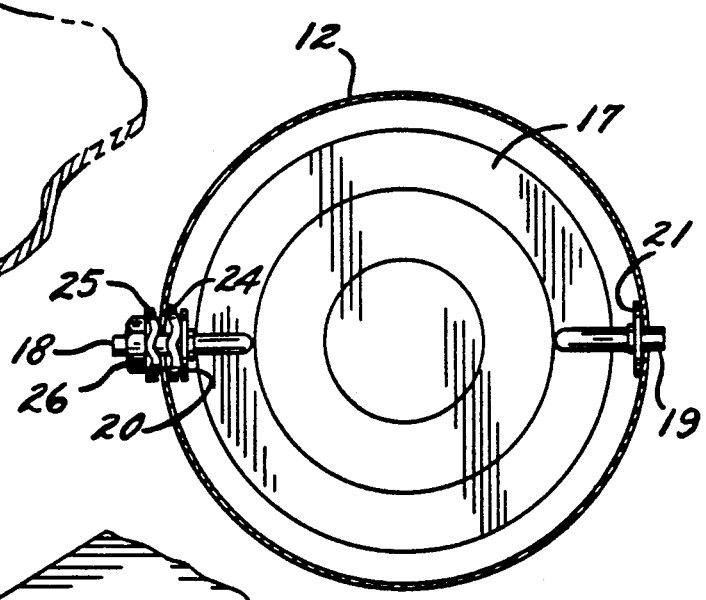
Fig. 4.
Fig. 5.

DAMPER ASSEMBLY FOR AIR PLENUM SYSTEM

BACKGROUND OF THE INVENTION

The present invention relates to an air plenum system adapted to provide a predetermined air flow through each of several outlets.

Conventional heating or air conditioning systems include a central air plenum, with a plurality of air duct lines running outwardly therefrom to distribute the air flow into a large area or several rooms. A damper is commonly positioned in each line adjacent the central air plenum, and each damper is manually controlled by an external handle or lock nut. While this configuration satisfactorily regulates the air flow, access to the various dampers to regulate or change the air flow distribution is often difficult by reason of space limitations.

In residential applications, it is common to mount a grating with movable shutters, commonly referred to as an "air diffuser", so as to cover the outlet end of each air duct line and lie flush with the interior wall in the room. Such air diffusers are able to provide a degree of control of the air flow from the air duct line, but they are not able to effectively control high flow rates since they generate a whistling noise when moved to the closed position.

It is accordingly an object of the present invention to provide an air plenum system which is adapted to provide a predetermined air flow through each of several outlets, and which is readily accessible to regulate or change the air distribution among the several outlet lines.

It is another object of the present invention to provide a damper assembly for an air plenum system which is structurally simple, reliable in operation, and which avoids a whistling noise when moved to the closed position.

SUMMARY OF THE INVENTION

The above and other objects and advantages of the present invention are achieved in the embodiments illustrated herein by the provision of an air plenum system which comprises a central air plenum, and a plurality of air duct lines running outwardly from the central air plenum. Each of the air duct lines includes a peripheral wall and an outlet end, and an air damper assembly is positioned in each of the air duct lines for controlling the rate of air flow therethrough from the central air plenum. Each of the air damper assemblies comprises a plate positioned in the air duct line and which has an outline which generally conforms to the outline of the peripheral wall of the air duct line. A pair of rods are mounted coaxially to opposite sides of the plate and define a pivot axis, and aligned openings are provided in the peripheral wall of the air duct line which receive the rods so as to permit pivotal movement of the plate about the pivot axis between a closed position substantially transverse to the air duct line and an open position substantially aligned with the air duct line. Also, pivotal resistance means is mounted on at least one of the rods for restraining pivotal movement of the plate and so as to permit such movement only upon the application of a predetermined external force thereto. Further, the plate is located a predetermined distance spaced from the outlet end of the air duct line so as to permit a person to manually reach through the outlet end and physically pivot the plate to a desired rotational setting.

In the preferred embodiment, the pivotal resistance means comprises at least one wave washer positioned on one of the rods, and means for pressing the wave washer against the peripheral wall of the air duct line. This pressing means preferably comprises a nut which is threadedly mounted on the rod and which is adapted to press the wave washer against the peripheral wall. Also, in order to maintain the plate centered in the air duct line, it is preferred to mount a collar on each of the rods and between the plate and the peripheral wall for limiting movement of the plate in a direction parallel to the pivotal axis.

The preferred embodiment also includes an adjustable air diffuser mounted to cover the outlet end of each air duct line and so as to be downstream of the associated air damper assembly. The air diffuser permits the direction of the air flow into the room to be controlled, and the air flow rate to be further controlled.

BRIEF DESCRIPTION OF THE DRAWINGS

Some of the objects and advantages of the present invention having been stated, others will appear as the description proceeds, when taken in conjunction with the accompanying drawings in which

FIG. 3 is a perspective view of one of the air duct lines and its internal damper plate;

FIG. 4 is a sectional view taken substantially along the line 4—4 of FIG. 3;

FIG. 5 is a fragmentary perspective view of a second embodiment of an air plenum system in accordance with the present invention;

DETAILED DESCRIPTION OF THE PREFERRED EMBODIMENT

Figures 1, 2:
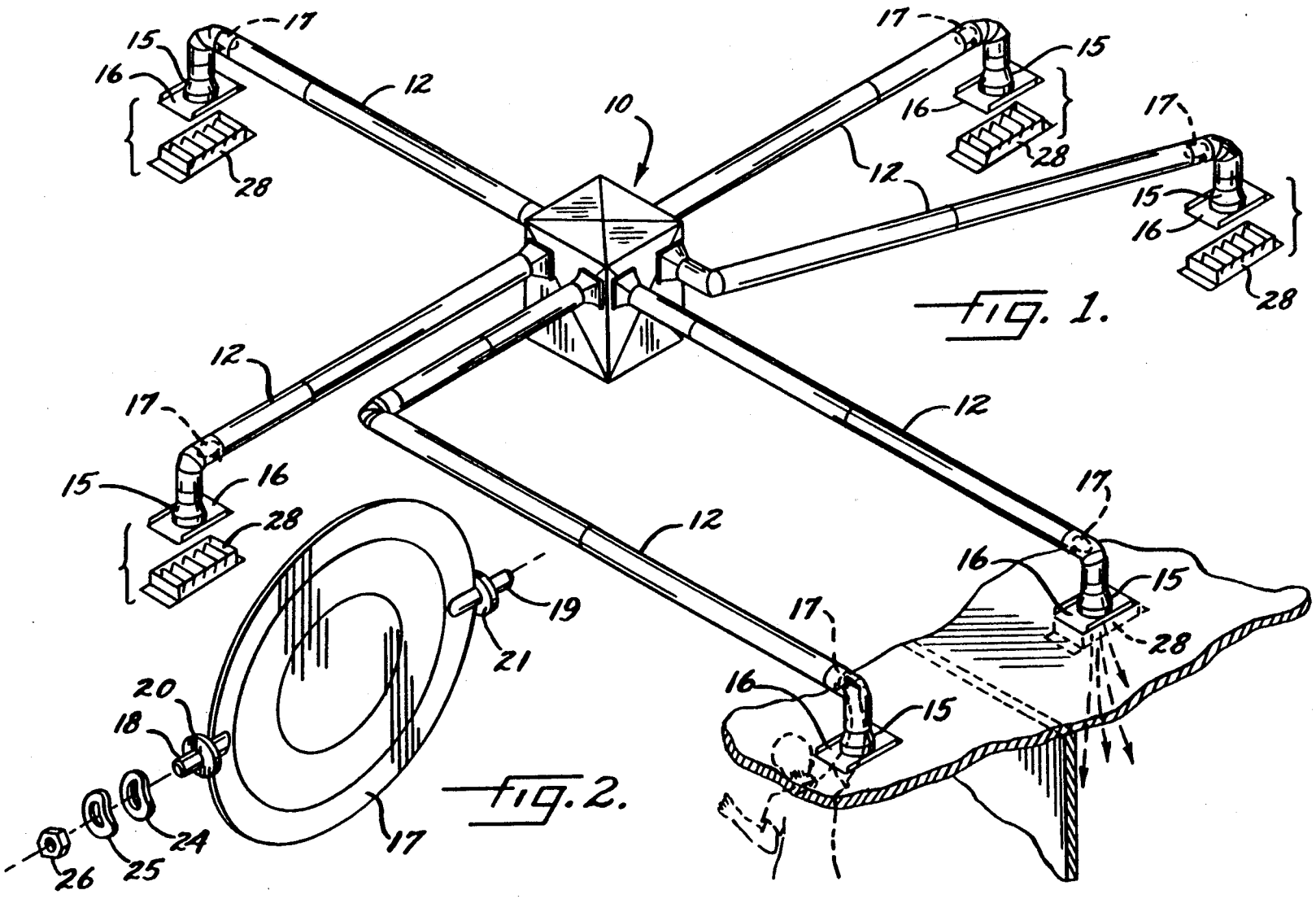
FIG. 1 is a fragmentary perspective view of an air plenum system which embodies the features of the present invention.
FIG. 2 is a perspective view of the damper plate of each damper assembly.

Referring more particularly to the drawings, FIG. 1 illustrates one embodiment of an air plenum system which embodies the features of the present invention. The system includes a central air plenum 10, which is provided with a supply of heated or otherwise conditioned air by a blower (not shown) in the conventional manner. A plurality of air duct lines 12 run outwardly from the central air plenum, and each of the air duct lines includes a circular peripheral wall, and an outlet end 15 having a transverse mounting plate 16 fixed thereto. In a typical installation, the outlet ends 15 of the lines open into different areas of a large room, or into a plurality of different rooms in a building.

In accordance with the present invention, the system further includes an air damper assembly which is positioned in each of the air duct lines 12 for separately controlling the rate of air flow therethrough from the central air plenum 10. Each of the air damper assemblies comprises a circular plate 17 positioned in the air duct line and which has a circular outline which generally conforms to but is somewhat smaller than the outline of the circular peripheral wall of the air duct line 12, note FIG. 4. A pair of rods 18, 19 are mounted coaxially to opposite sides of the plate 17 and define a pivot axis, and the rods 18, 19 extend through aligned openings in the peripheral wall of the air duct line so as to permit pivotal movement of the plate about the pivot axis More particularly, each plate 17 may be pivoted between a closed position substantially transverse to the air duct line as seen in FIGS. 3 and 4, and an open position substantially aligned with the air duct line.

Each of the rods 18, 19 fixedly mounts a collar 20, 21 respectively, which is positioned between the plate 16 and the peripheral wall, for the purpose of limiting movement of the plate in a direction parallel to the pivot axis and thus maintaining the plate centered in the air duct line. Further, pivotal resistance means is mounted on the rod 18 for restraining pivotal movement of the plate 17 and so as to permit such movement only upon the application of a predetermined external force thereto. As best seen in FIG. 4, this pivotal resistance means comprises a first wave washer 24 positioned on the rod 18 between the collar 20 and the peripheral wall of the air duct line 12, and a second wave washer 25 positioned on the rod 18 outside of the peripheral wall. Further, the rod 18 is externally threaded, and a nut 26 is threadedly mounted on the rod 18 so as to permit the wave washers to be compressed against the peripheral wall. As will be apparent, the washers 24, 25 thus engage the peripheral wall with a spring loaded frictional force, and the tightness of the nut 26 on the rod 18 will serve to control the spring loaded force and thus the force required to pivot the plate 17 about the pivotal axis.

As a further aspect of the present invention, the plate 17 is located a predetermined distance spaced from the outlet end 15 of the air duct line, and so as to permit a person to manually reach through the outlet end and physically pivot the plate to a desired rotational setting, note the lower portion of FIG. 1. This predetermined distance is typically between one and two feet.

The illustrated system also includes an adjustable air diffuser 28 mounted to cover the outlet end 15 of each of the air duct lines 12, and so as to be downstream of the associated air damper assembly. The air diffuser 28 may be of conventional design, and it is removably mounted so as to lie flush with the wall of the room, and it comprises a plurality of parallel shutters which are movable in unison between open and closed positions.

Once the above described system is installed, the air flow rate through each of the air duct lines 12 may be separately adjusted by removing the air diffusers 28, and manually reaching into the air duct line and pivoting the damper plate 17 to the desired rotational setting. As indicated above, the tightness of the nut 26 on the rod 18, and thus the frictional spring loaded force between the two wave washers 24, 25 and the peripheral wall 14 of the line, serves to maintain the set positioning of the damper plate 17 against the force of the flowing air. When the air diffuser 28 is re-positioned over the outlet end 15, it may be used to control the direction of the flow into the room. Also, when the air damper assembly is essentially closed, the air diffuser 28 may be employed to completely close the air flow, without a whistling air noise.

Figure 6:
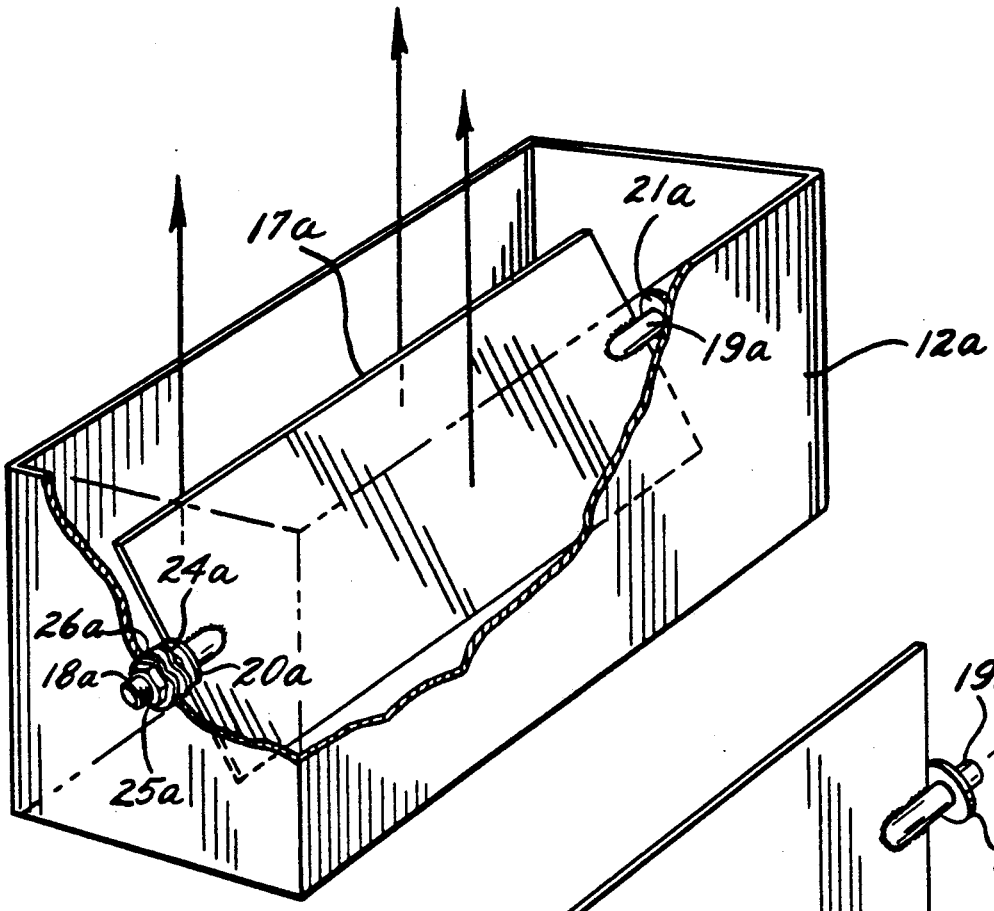
FIG. 6 is a fragmentary perspective view of a portion of the air duct line and associated damper plate of the embodiment of FIG. 5.
Figure 7:
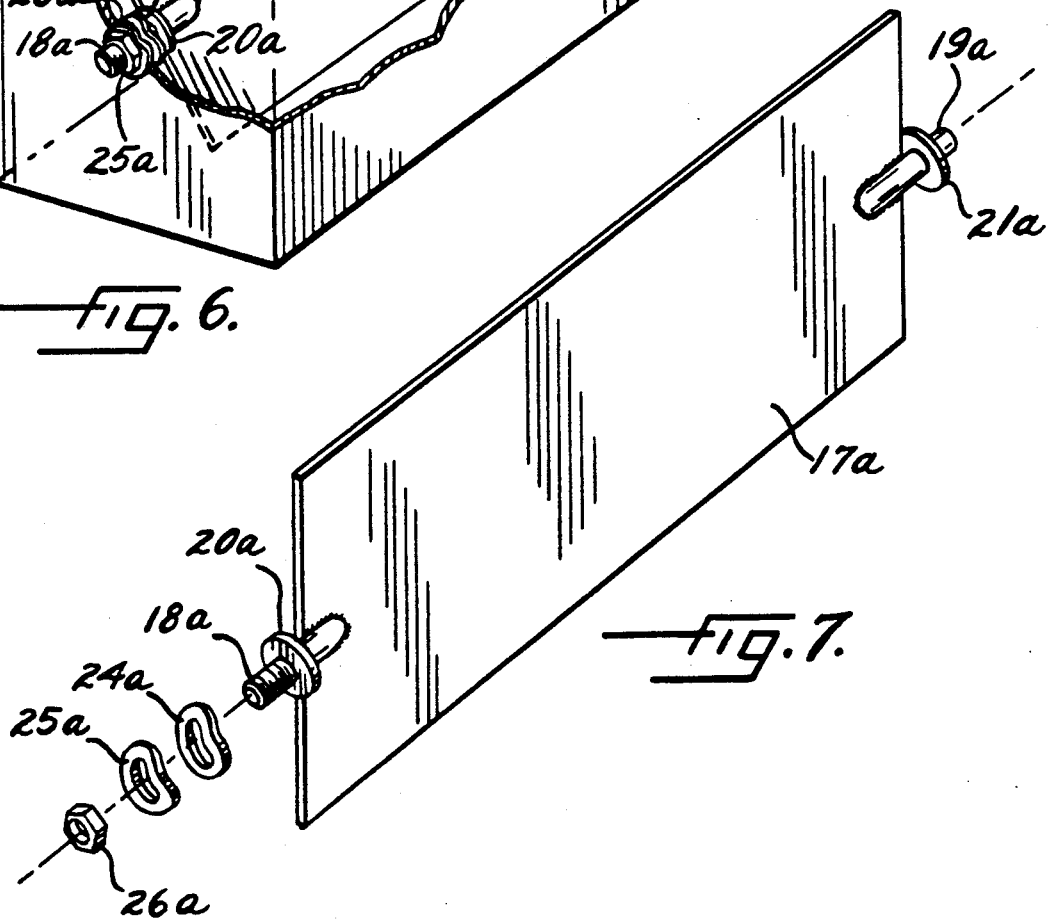
FIG. 7 is a perspective view of the damper plate of the embodiment of FIG. 5.

FIGS. 5–7 illustrate a second embodiment of the invention, and the components of the second embodiment which correspond to the components of the first embodiment are indicated by the same numeral with the subscript a. This second embodiment differs from the initial embodiment only in that the end portions of the air duct lines **12*a* leading from the central air plenum 10*a* are rectangular in outline, as opposed to circular. Also, the damper plate 16*a* has a corresponding rectangular outline as best seen in FIGS. 6 and 7**.

In the drawings and specification, there has been set forth preferred embodiments of the invention, and although specific terms are employed, they are used in a generic and descriptive sense only and not for purposes of limitation.

That which is claimed is:

1. An air plenum system adapted to provide a predetermined air flow through each of several outlets, and comprising a central air plenum, a plurality of air duct lines running outwardly from said central air plenum, which each of said air duct lines including a peripheral wall and an outlet end, and an air damper assembly positioned in each of said air duct lines for controlling the rate of air flow therethrough from each said central air plenum, each of said air damper assemblies comprising a plate positioned in the air duct line and having an outline which generally conforms to the outline of the peripheral wall of the air duct line, a pair of rods mounted coaxially to opposite sides of the plate and defining a pivot axis, with said rods extending through aligned openings in the peripheral wall of the air duct line so as to permit pivotal movement of said plate about said pivot axis between a closed position substantially transverse to the air duct line and an open position substantially aligned with the air duct line, and pivotal resistance means mounted on at least one of aid rods for restraining pivotal movement of the plate and so as to permit such movement only upon the application of a predetermined external force thereto, said pivotal resistance means comprising external threads on said one rod, at least one first wave washer positioned on said one rod outside of said air duct line, a collar fixed to said one rod between the plate and the peripheral wall, and at least one second wave washer positioned on said rod between said collar and the peripheral wall, and means for pressing said wave washers against the peripheral wall comprising a nut threadedly mounted on said washer, and wherein said plate is located a predetermined distance spaced from said outlet end of the air duct line and so as to permit a person to manually reach through said outlet end and physically pivot the plate to a desired rotational setting.

2. The air plenum system as defined in claim 1 further comprising a second collar fixed to the other of said rods between the plate and the peripheral wall for limiting movement of the plate in a direction parallel to said pivotal axis and thus maintaining the plate centered in the air duct line.

3. The air plenum system as defined in claim 1 further comprising adjustable air diffuser means mounted to cover said outlet end of each of said air duct lines and so as to be downstream of the associated air damper assembly.

4. An air damper assembly comprising an air duct line including a peripheral wall and an outlet end, a plate positioned in the air duct line and having an outline which generally conforms to the outline of the peripheral wall of the air duct line, a pair of rods mounted coaxially to opposite sides of the plate and defining a pivot axis, with said rods extending through aligned openings in the peripheral wall of the air duct line so as to permit pivotal movement of said plate about said pivot axis between a closed position substantially transverse to the air duct line and an open position substantially aligned with the air duct line, pivotal resistance means mounted on at least one of said rods for restraining pivotal movement of the plate and so as to permit such movement only upon the application of a predetermined external force thereto, said pivotal resistance means comprising external threads on said one rod, at least one first wave washer positioned on said one rod outside of said air duct line, a collar fixed to said one rod between the plate and the peripheral wall, and at least one second wave washer positioned on said rod between said collar and the peripheral wall, and means for pressing said wave washers against the peripheral wall comprising a nut threadedly mounted on said one rod outside of the peripheral wall and said one first wave washer, adjustable air diffuser means removably mounted to cover said outlet end of said air duct line, and said plate being located a predetermined distance spaced from said outlet end of the air duct line and so as to permit a person to remove said air diffuser means and manually reach through said outlet end and physically pivot the plate to a desired rotational setting.

5. The air damper assembly as defined in claim 4 further comprising a second collar fixed to the other of said rods between the plate and the peripheral wall so that the two collars serve to limit movement of the plate in a direction parallel to said pivotal axis and thus maintain the plate centered in the air duct line.

6. The air damper assembly as defined in claim 4 wherein said air duct line and said plate each have a circular outline.

7. The air damper assembly as defined in claim 4 wherein said air duct line and said plate each have a rectangular outline.

8. The air damper assembly as defined in claim 4 wherein said air diffuser means includes a plurality of parallel shutters which are movable in unison between open and closed positions.

9. An air damper assembly comprising an air duct line including a peripheral wall and an outlet end, a plate positioned in the air duct line and having an outline which generally conforms to the outline of the peripheral wall of the air duct line, a pair of rods mounted coaxially to opposite sides of the plate and defining a pivot axis, with said rods extending through aligned openings in the peripheral wall of the air duct line so as to permit pivotal movement of said plate about said pivot axis between a closed position substantially transverse to the air duct line and an open position substantially aligned with the air duct line, pivotal resistance means for restraining movement of the plate and so as to permit such movement only upon the application of a predetermined external force thereto, said pivotal resistance means comprising at least one spring biasing member positioned on one of said rods adjacent said peripheral wall, and means for pressing said one spring biasing member against said peripheral wall, adjustable air diffuser means removably mounted to cover said outlet end of said air duct line and including a plurality of parallel shutters which are movable in unison between open and closed positions, and said plate being located a predetermined distance spaced from said outlet end of the air duct line and so as to permit a person to remove said air diffuser means and manually reach through said outlet end and physically pivot the plate to a desired rotational setting.

* * * * *

UNITED STATES PATENT AND TRADEMARK OFFICE

CERTIFICATE OF CORRECTION

PATENT NO. : 5,207,615

DATED : May 4, 1993

INVENTOR(S) : John H. Edmisten

It is certified that error appears in the above-identified patent and that said Letters Patent is hereby corrected as shown below:

Column 3, line 5, after "axis" insert -- . --.

Column 4, line 17, delete "which" and insert -- with --.

Column 4, line 22, delete "each" (first occurrence).

Column 4, line 36, "aid" should be -- said --.

Column 4, line 49, after "said" insert -- one rod outside of the peripheral wall and said one first wave --.

Column 6, line 25, after "restraining" insert -- pivotal --.

Signed and Sealed this

Eighth Day of February, 1994

Bruce Lehman

*Attest:*

BRUCE LEHMAN

*Attesting Officer*

*Commissioner of Patents and Trademarks*